US005513822A

United States Patent [19]

Gould

[11] Patent Number: 5,513,822

[45] Date of Patent: May 7, 1996

[54] DEVICE AND METHOD FOR HOLDING OPEN BAGS

[76] Inventor: Arthur Gould, 1690 W. Sixth St., Reno, Nev. 89503

[21] Appl. No.: 167,247

[22] Filed: Dec. 15, 1993

Related U.S. Application Data

[63] Continuation-in-part of Ser. No. 954,867, Sep. 30, 1992, abandoned.

[51] Int. Cl.[6] ..... B65B 67/04

[52] U.S. Cl. ..... 248/99; 15/257.4; 15/257.9

[58] Field of Search ..... 248/99, 100, 74.2, 248/300, 302, 60, 95; 15/257.1, 257.4, 257.9; 141/390; 294/1.1, 55

[56] References Cited

U.S. PATENT DOCUMENTS

| | | | |
|---|---|---|---|
| 393,001 | 11/1988 | Evans | 248/300 |
| 939,508 | 11/1909 | Hull | 248/95 |
| 1,329,268 | 1/1920 | Dickelmann et al. | 248/300 |
| 1,714,308 | 5/1929 | Gunderson | 248/95 X |
| 3,604,677 | 9/1971 | Gits | 248/99 X |
| 4,069,994 | 1/1978 | Wharmby | 248/99 X |
| 4,482,116 | 11/1984 | Vadnais | 248/99 |
| 4,615,743 | 10/1986 | Bylenga . | |
| 4,664,348 | 5/1987 | Corsaut, III et al. | 248/99 |
| 4,723,803 | 1/1988 | Sapp . | |
| 4,749,011 | 6/1988 | Rylander . | |
| 4,874,141 | 10/1987 | Schulz | 248/99 X |
| 5,014,943 | 5/1971 | Nelson et al. | 248/99 |
| 5,183,339 | 2/1973 | Williams | 248/99 X |

*Primary Examiner*—Alvin C. Chin-Shue
*Assistant Examiner*—Korie H. Chan
*Attorney, Agent, or Firm*—Ladas & Parry

[57] ABSTRACT

Trash bags are easily kept open to allow filling by first forming a collar in the top of the bag by folding a portion of the top inside out. Into this collar is fitted a semi-rigid resilient bar which forms an arch in the top of the bag. In a preferred embodiment of the invention, the resilient bar is made of a plastic material selected from acrylonitrile-butadiene-styrene, high impact polystyrene or the like and has bag perforating means which can be used to support the bag when carrying the bag in which debries is present. The perforating or support means are located on the ends of the device.

6 Claims, 5 Drawing Sheets

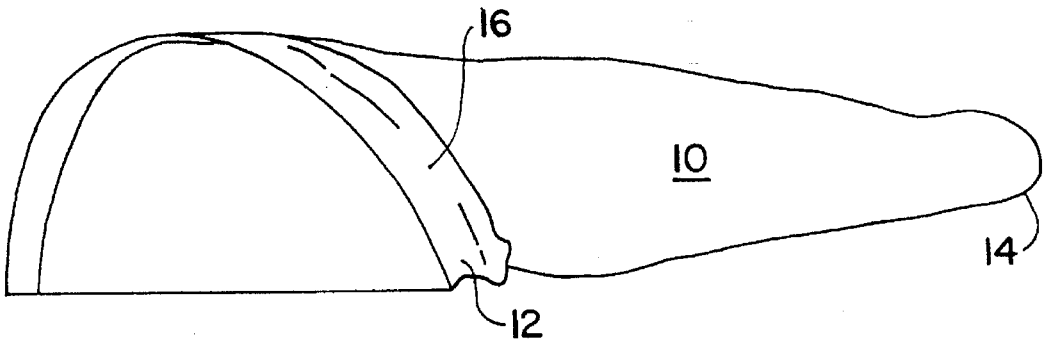
Fig. 1
Fig. 2
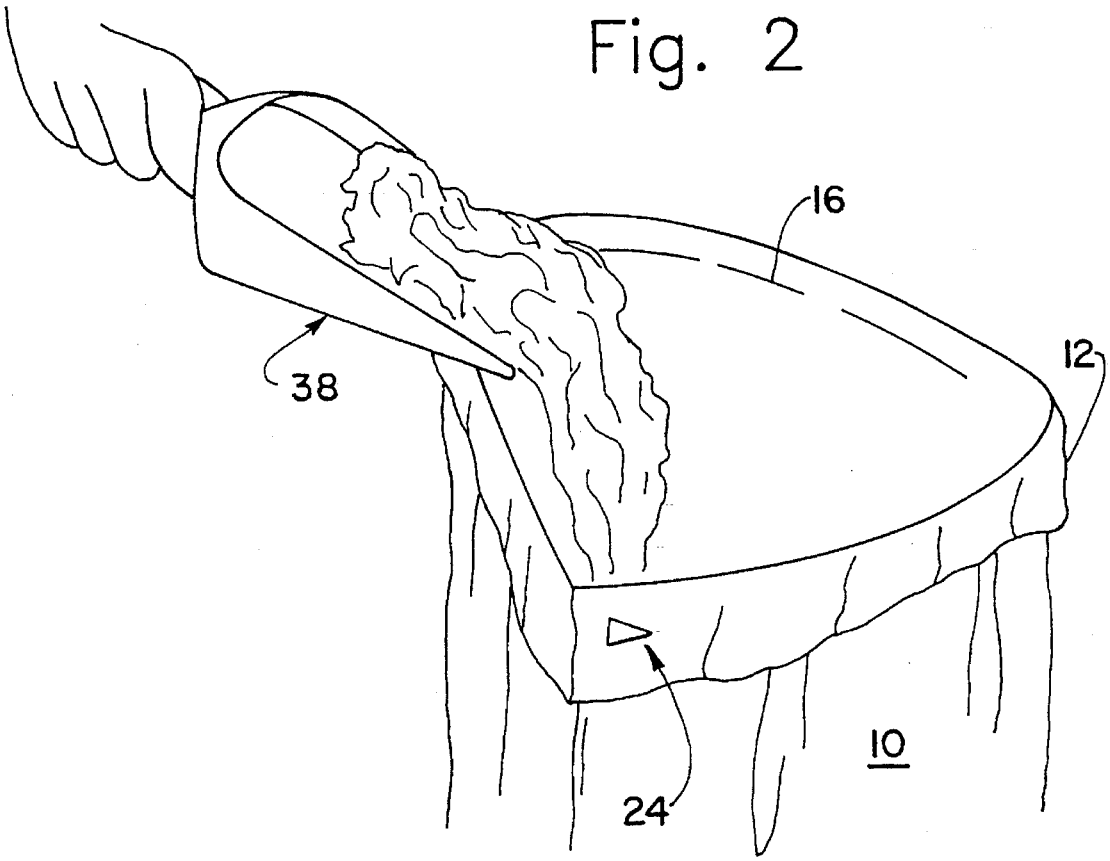

DEVICE AND METHOD FOR HOLDING OPEN BAGS

This is a continuation-in-part application of serial No. 07/954,867 filed Sep. 30, 1992 now abandoned.

FIELD OF THE INVENTION

The invention relates to a device and method for holding trash bags open so that they may be filled easily.

INTRODUCTION

Trash bags, particularly the large plastic bags used to collect yard and garden waste, are difficult to start to fill since they are awkward to hold open to allow the shoveling or raking of debris and trash into them. Usually, with the bag laid on the ground one hand holds open a portion of the top while the other hand scoops with a rake or a shovel the debris sought to be added to the bag. This awkward technique is compounded with respect to difficulty and efficiency when high winds are present. A similar problem occurs when it is sought to hand hold the bag open vertically.

A basic approach to solving this problem has been the prior art's use of various types of frames most of which fit inside the bag to hold it open during its filling. Many of these frames are large in size and are often awkward to fit inside the bag. Since they are designed to fit inside the bag they are in most instances rigid devices requiring a large storage space.

If it were possible to provide a device and method for easily holding open trash bags which was simple in design, small, readily stored, stored so as to take up very little space, inexpensive and easy to use a valuable contribution to the art would be afforded. Further, if a device could be made whereby the user could easily and conveniently store and transport the device on his person while continuing to fill the bag an even greater advance in the art may be afforded.

SUMMARY OF THE INVENTION

In its broadest aspects the invention comprises a device and method for holding open trash bags. It comprises a semi-rigid elongated member of resilient material capable of being formed into an arc or circle and having a length of at least ½ the distance of the perimeter of the opened trash bag. The device is adapted to be received inside a collar in the top of the trash bag which is formed by turning the upper portion of the open end of the bag inside out.

Also, the bag can be easily mounted in the device by manipulating the device and interlocking or hooking the ends which include engaging or perforating means. With the device in this circular shape a bag is inserted within the circle and a collar is formed over the device. This method of "loading" the bag is similar to the loading of a bag into a garbage can. Once the collar has been formed the engaging or perforating means are released and spring open as far as the bag will allow. What is formed is essentially a half moon shaped configuration whereby the flat, non-circular portion of said configuration allows one person to easily rake or sweep debris into the bag. Barbed hooks or other attaching means can then be used to secure the bag to the device to enable vertical loading of the bag.

Essentially, the device allows one person to do a job with ease which could require two; one to hold a bag open and another to fill the bag.

THE DRAWINGS

FIG. 1 is a horizontal perspective view of a trash bag having a collar which contains the device of the invention, FIG. 2 is a vertical perspective view of the trash bag of FIG. 1 being filled with a scoop, FIG. 3 is a horizontal partial top view of a flexible, resilient bar of the invention.

FIGS. 4–8 are horizontal partial top views of the flexible, resilient bar shown in FIG. 3 whose ends contain bag perforating means, FIG. 9 shows an embodiment of the device and how to manipulate the device to engage a bag, FIG. 10 shows an embodiment comprising bag perforating means and a barb, FIG. 11 shows the two perforating means connected to make the device circular for one method of loading the bag.

In the drawings like parts have like numbers.

SPECIFIC EMBODIMENTS OF THE INVENTION

Specifically, there is shown in FIGS. 1 and 2 a trash bag 10 which has a top 12 and a bottom 14. Top 12 has had a portion thereof turned inside out to form a collar 16. Fitted inside the collar is the device of the invention which is not visible in FIGS. 1 and 2 but is illustrated in its various embodiments in FIGS. 3–13.

Figure 3:
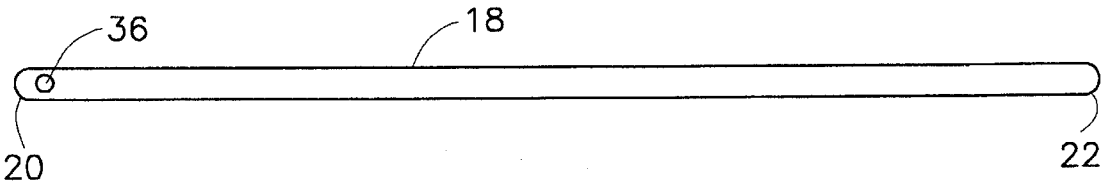

The device in it simplest form is shown in FIG. 3 to comprise a bar 18 having ends 20 and 22. The bar 18 is constructed of a material so as to render it both flexible and resilient. In length it is at least about ½ the distance of the perimeter of the opened trash bag 10. Typically the length of the bar 18 in relation to the distance of the perimeter of the bag's 10 opening should be between about ½ to ⅔ of such distance, with about ⅔ being preferred.

A typical dimension of the bar 18 in relation to a 2'4"–2'9" plastic trash bag, would be about 42" long. It would have a width of 1¼". The thickness typically would range between 1/16 of an inch up to about 3/16 of an inch depending on the material of construction. The length and width of the bar 18 would be varied to adapt it to the size bag with which it was to be used.

The bar 18 should be constructed of a material that is both semi-rigid and resilient, e.g. can be formed into an arc, or a semi-circle or a complete circle. Typical of such materials are wood, bamboo, metal and plastics. Plastics are preferred. Particularly preferred are those plastics that have so called "memory". Such plastics are so resilient that they always tend to return to their original shape. A desirable plastic possessing this property to a satisfactory degree as well as being strong is high impact polystyrene with less brittle plastics such as acrylonitrile-butadiene-styrene (ABS) plastic) and the like being preferred.

Figure 4:
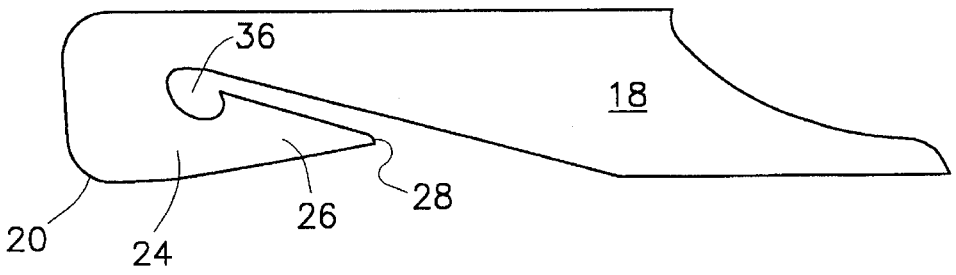
Figure 5:
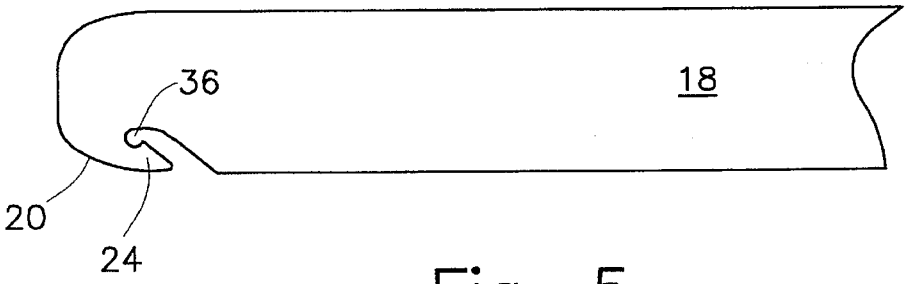
Figure 6:
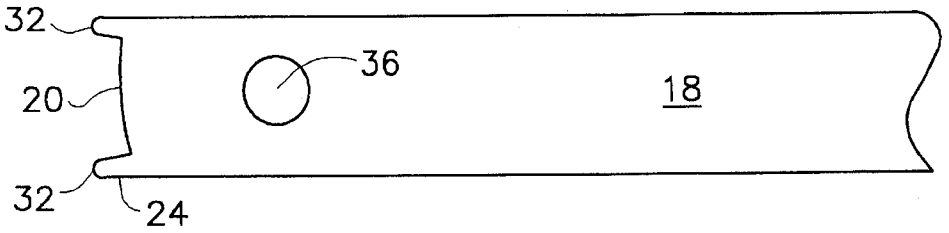
Figure 7:
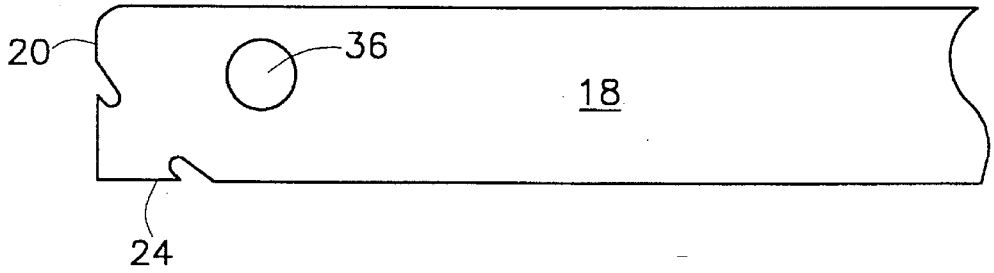
Figure 8:
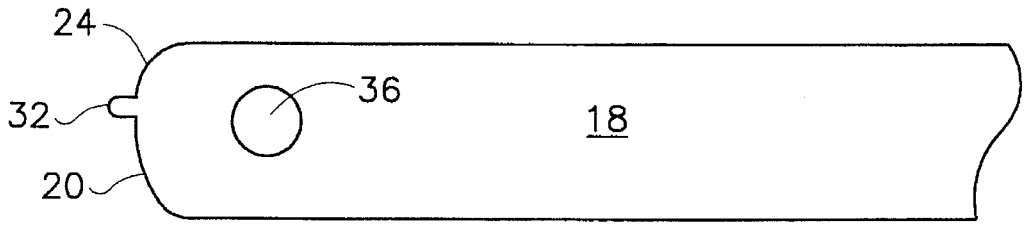
Figure 10:
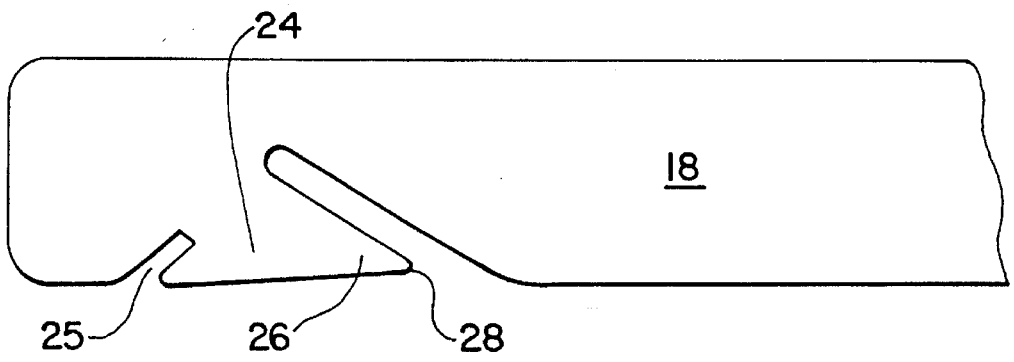

The bars 18 shown in FIGS. 4–8 and 10 represent preferred embodiments of the invention. Positioned at or near the ends 20 and 22 of the bars 18 are several bag perforating means 24. These perforating means 24, may also serve as a support when the bag is carried. FIG. 4 shows the perforating means 24 and an internally barbed hook 26 which has a blunt safety hook end 28 to prevent injury. FIG. 10 shows the most preferred embodiments containing perforating means 24 and additionally a lower barb 25. The perforating means 24 effectively keeps the bag material engaged and from slipping down off the end of the device. The lower barb 25 keeps the bag material from working its way up and over the lower barb. The smooth top portion of the device allows the bag material to slide open easily when the bag is loaded into the device as described hereinabove. FIG. 5 shows the perforating or support means to be a bottle cap opener shaped hook 30. The perforating or support means in FIG. 6 are two end positioned tabs 32. FIG. 8 is identical to FIG. 6 except that the ends 20 and 22 contain a single tab 32. FIG. 19 shows the perforating or support means to be an arrow shaped tip 34 protruding from the lower corners of ends 20–22.

In an optional yet desirable embodiment of the invention one of the ends either 20 or 22 of the bar 18 are fitted with mounting hole 36. This allows the bar 18 to be stored on a hook or nail when not in use. These mounting holes are shown in FIGS. 3–9.

Another method for installing the bar 18 onto the bag is to first open the trash bag 10 and outwardly fold from the inside out several inches of the top of the bag over onto itself to form the collar 16. In the case of a bar having a width of 1¼" the collar would be between about 5"–10" in width. After the collar 16 has been formed one of the ends 20 or 22 of the bar 18 would be inserted into the open end of the collar. Thereafter the remainder of the bar would be urged into the collar 16 by gradually flexing the bar into an arc, semi-circle or circle while it is being positioned. After the bar 18 is inserted it is released. This causes the bar, due to its resiliency or "memory", to force itself against the collar 16 thereby forming an arcuate in the top 12 of the trash bag 10. Due to size, shape and rigidity of the bar 18 the opening formed will not collapse and thereby allows the trash bag 10 to be handled in a fashion whereby trash, debris or other materials may be placed into the bag without its closing.

Figure 11:
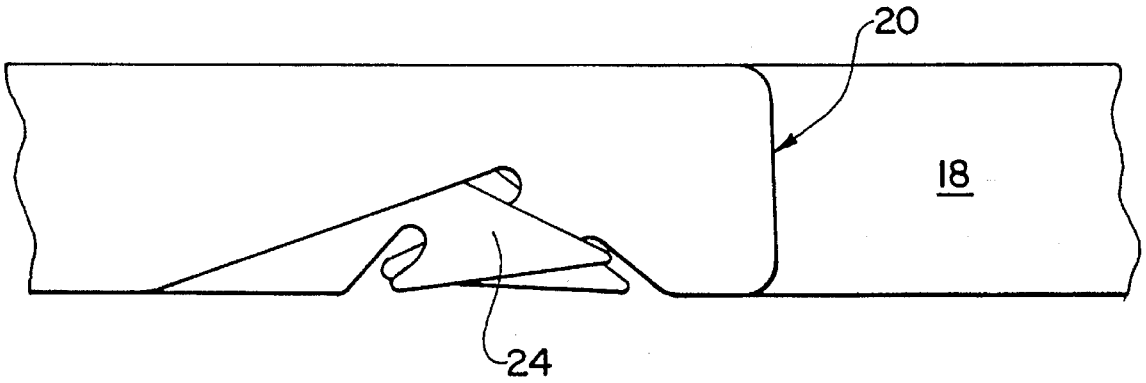

FIG. 11 shows a preferred embodiment for utilizing the device wherein the perforating means 24 from each end of the device are locked together to form a circle. The bag material is then loaded inside the circle, in a manner similar to loading a bag into a garbage can with a collar being formed over the outside portion of the device. The perforating means are then disengaged, thus allowing the device to spring open due to the resiliency or "memory" and thus forming the configuration as displayed in FIGS. 1 and 2.

Figure 12:
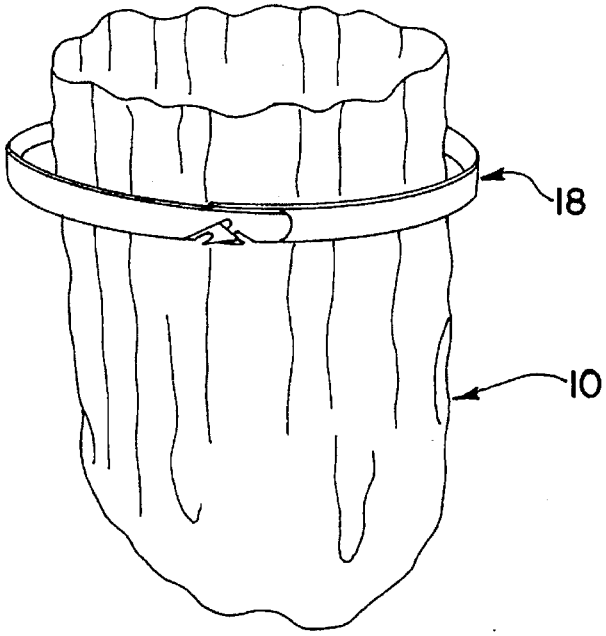
FIG. 12 shows how a bag is loaded into the device when it is in a circular configuration and prior to the device being released to be formed into the configuration of FIG. 1.

FIG. 12 shows a bag 10 being loaded into the device.

Figure 13:
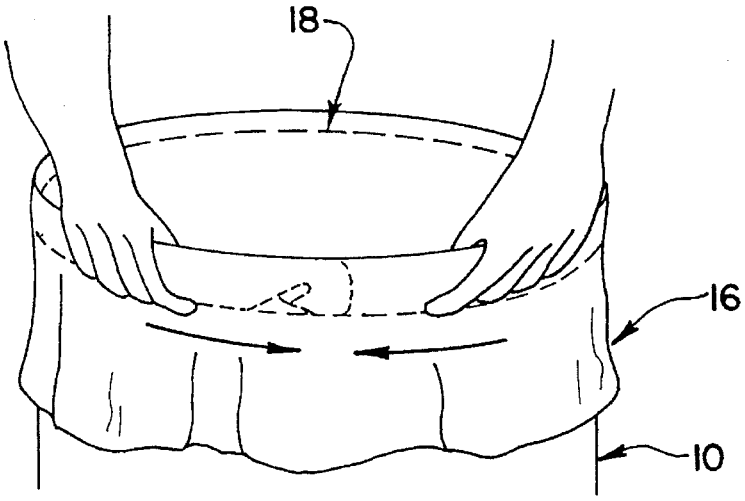
FIG. 13 shows the device after a bag has been loaded therein and the perforating means are going to be disengaged.

FIG. 13 shows the bag material 10 after having been loaded onto the device 18 which has been formed into a circle with a collar 16 having been formed. The device 18 is pressed in a manner as illustrated so that the perforating means which have been joined are disengaged. This allows the device to spring open due to the "memory" of the material of which the device is comprised.

Figure 9:
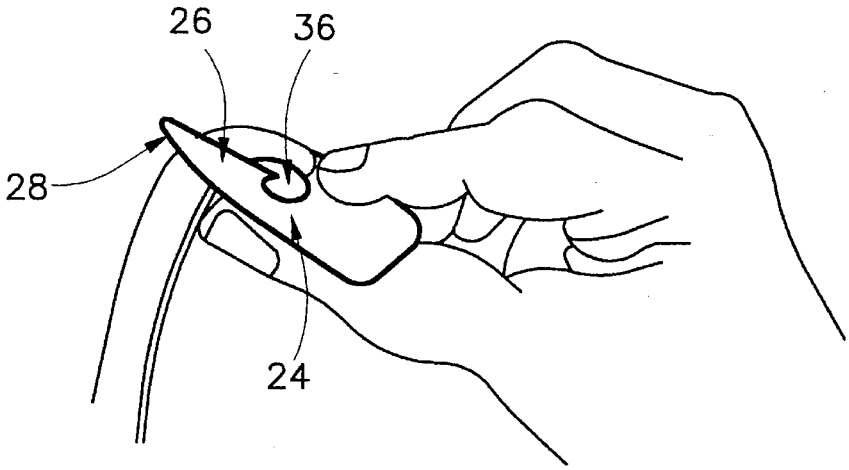

When bars 18 containing engaging or perforating support means 24 are used, the release of the bar 18 against the collar sets the engaging or perforating means into the plastic by producing a snag in the top 12 of the bag 10 or of the collar 16. In some instances the engaging or perforating support means 24 must be manually manipulated to make sure there is good engagement with the bag 10 or the collar 16. FIG. 9 shows how the bag may be engaged or penetrated by manipulating the perforating or support means 24, by bending said perforating means slightly and releasing the hook to engage the bag 10. The bar 18 being thus fastened to the bag 10 allows the bag to be held by grasping the center of the bar 18 without disengagement of the bag from the bar occurring. The engagement or perforation support of the bag may only be necessary when one desires to carry a partially loaded bag. When not carrying the bag, and if there is no wind present the hooks may not be needed.

After the bar 18, is inserted into the collar 16 the bag 10 is ready for use. As shown in FIG. 1 when the bag is placed on the ground its top is in the shape of an arcuate opening. Trash, garden and lawn debris easily can be added to the bag 10 by sweeping, raking or shoveling. If it is desired to carry the bag 10 it must be attached to the device in the manner described hereinabove by engaging the bag material with the perforating means and grasped by the center of the collar area which contains bar 18. Shown in FIG. 2 waste material can be added to a vertically held bag 10 by scoop 38. After the trash bag 10 is partially filled the bar 18 may be removed from the collar 16. The device may be stored on the body as a belt, formed into a circle as shown in FIG. 12 and warn on the body as a bandoleer or the like. The bag 10 in this partially filled condition will remain open to allow a more complete filling.

It is understood that the invention is subject to obvious equivalents without departing from the scope of the claims. For instance, the bar 18 may be rod shaped. Similarly the bar 18 may be made from two pieces which slidably engage each other in curtain rod fashion thereby making it adjustable to fit different size trash bags. The engaging or perforating means 24 may be in the form of pins located on the end faces of the bars.

Various lengths, widths and thicknesses of the device have been contemplated. For instance, in one embodiment a device having a thickness of 1/16" has proven to be very beneficial to the user. For instance, the user can easily manipulate the device to engage the bag. Then, after the bag is full enough to remain open without the aid of the device it is easily stored on the body of the user as herein before described and allowing easy temporary storage while at the same time affording the user a free hand to collect the debris.

While the invention has been described with respect to trash bags and in particular plastic trash bags these terms are also meant to include paper trash bags.

Having described my invention it is claimed as follows:

1. A device for holding open bags comprising an elongated member of resilient material defined at each end by bag retaining slits disposed adjacent to each of said ends and extending inwardly from one longitudinal edge of said member at angles such that the slits oppose one another, and by bag perforating means formed in said member, bag perforating means include slots disposed adjacent the respective bag engaging slit and extending inwardly at angles from said longitudinal edge opposite to that of the adjacent bag engaging slit to define therewith an integral barbed fastener at each of said ends of said member, said slits and said perforating means being co-planar with the device such that said barbed fasteners are adapted to pierce said bag.

2. The device of claim 1 wherein the elongated member is formed from flexible plastic, wood or metal.

3. The device of claim 1 wherein the elongated member comprises a member of strip-like form.

4. A trash bag assembly including in combination a bag having a collar formed by turning inside out a portion of the top of said bag and the device of claim 1 wherein the device is formed into a circle by engaging the perforating means, placing the bag inside the formed circle of the device, forming the collar, releasing the perforating means and attachably fastening the bag to the device by perforating the bag with each of said perforating means.

5. The trash bag assembly of claim 4 wherein the device is formed from flexible plastic, wood or metal.

6. The device of claim 1, wherein the barbed fastener is capable of being twisted slightly away from the plane of said device to facilitate the piercing of said bag.

* * * * *

UNITED STATES PATENT AND TRADEMARK OFFICE

CERTIFICATE OF CORRECTION

PATENT NO. : 5,513,822

DATED : May 7, 1996

INVENTOR(S) : Arthur Gould

It is certified that error appears in the above—identified patent and that said Letters Patent is hereby corrected as shown below:

Column 4:

Claim 1, line 6 after "said member," Please insert "said".

Signed and Sealed this

Tenth Day of September, 1996

Bruce Lehman

*Attest:*

BRUCE LEHMAN

*Attesting Officer*

*Commissioner of Patents and Trademarks*